United States Patent [19]

Bailleul et al.

[11] Patent Number: 4,554,434

[45] Date of Patent: Nov. 19, 1985

[54] HEATING PLATE FOR PRINTING APPARATUS

[75] Inventors: Gilles Bailleul, Montesson; Patrick Coville, Le Chesnay, both of France

[73] Assignee: U.S. Philips Corporation, New York, N.Y.

[21] Appl. No.: 597,909

[22] Filed: Apr. 9, 1984

[30] Foreign Application Priority Data

Apr. 15, 1983 [FR] France ..... 83 06226

[51] Int. Cl.[4] ..... F27B 9/28; H05B 1/00

[52] U.S. Cl. ..... 219/216; 219/521; 219/388; 432/59

[58] Field of Search ..... 219/216, 521, 388, 542; 432/59, 60; 34/41; 165/171; 338/241

[56] References Cited

U.S. PATENT DOCUMENTS

| | | | |
|---|---|---|---|
| 2,375,676 | 5/1945 | Miller | 432/59 |
| 2,736,406 | 2/1956 | Johnson | 165/171 |
| 3,478,665 | 11/1969 | Umahashi | 219/216 |
| 3,517,164 | 6/1970 | Huggins | 219/216 |
| 3,816,705 | 6/1974 | Ebert | 219/521 |

FOREIGN PATENT DOCUMENTS

| | | | |
|---|---|---|---|
| 217702 | 5/1957 | Australia | 165/171 |
| 2733899 | 2/1979 | Fed. Rep. of Germany | 165/171 |
| 241602 | 8/1946 | Switzerland | 165/171 |

*Primary Examiner*—Roy N. Envall, Jr.
*Assistant Examiner*—Teresa J. Walberg
*Attorney, Agent, or Firm*—Robert S. Smith

[57] ABSTRACT

A heating plate for use in a drying device for the drying of inked paper produced by printing apparatus. The heating plate is formed by a sheet of metal having a central rectangular portion which serves to receive the inked paper and whose larger dimension at least equals the width of the inked paper in a direction perpendicular to the transport direction of the paper. The two sides of the plate which are parallel to the larger dimension are folded towards the underside in order to form two holders which serve to receive heating elements of a type which is clad with an insulating mineral.

5 Claims, 2 Drawing Figures

FIG.1
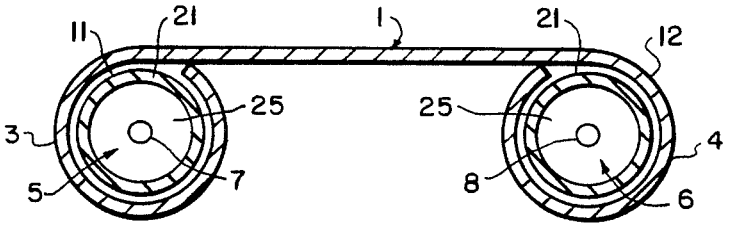
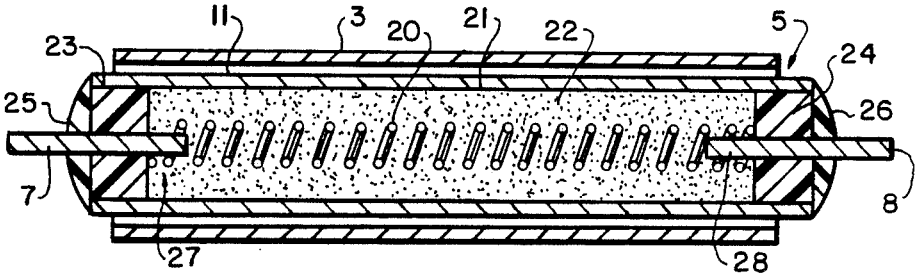
FIG.2

HEATING PLATE FOR PRINTING APPARATUS

The invention relates to a heating plate for use in drying devices for the drying of inked paper in printing apparatus.

In a first known type of such a drying device the metal heating plate comprises a smooth upper surface which serves to receive the paper and a lower surface on which there is provided a heating means in the form of a printed circuit comprising a heating resistor which is formed on a plastic foil by silk-screening. The foil serves as an insulator between the metal plate on which it is secured and the printed heating circuit. This device is very fragile, because in the long term the plastic foil cannot withstand the effects of the temperature to which it is exposed and which may become as high as 140° C. Moreover, it may be subject to accidental breakdowns between the heating circuit and the metal plate. In any case, the circuit will be destroyed by the breaking of the heating conductor.

In a second known device of this type, the heating circuit is again formed by silk-screening and is accommodated on a ceramic support which serves as an insulator between the metal plate and the circuit in the same way as the plastic foil in the device described above. It is a drawback of this device that the ceramic material cannot withstand the thermal shocks caused by the abrupt heating and cooling when the supply voltage is switched on and off. When the ceramic support breaks, the heating circuit arranged thereon is interrupted.

In a third known device of this type, the heating elements are formed by taut tungsten wires. This device has the drawback that the supply voltage must be continuously applied, because the supporting plate requires a very long period of time to reach a sufficiently high temperature for the drying of the inked paper.

Thus, it is an object of the invention to provide a device which is not affected by the temperature or by thermal shocks and in which the operating temperature can still be reached almost instantaneously.

This object is achieved in a device of the described kind in that the heating plate is formed by a metal sheet whose rectangular central portion which serves to receive the inked paper has a larger dimension perpendicular to the transport direction of the paper. The largest dimension at least equals the width of the paper, its two sides which are parallel to this dimension being folded towards the underside of the heating plate so as to form thereunder two holders which each serve to accommodate and retain a heating element.

In a preferred embodiment of the invention, the heating elements are of the type which comprises an insulating mineral.

In a further embodiment in accordance with the invention, the shape and the internal dimensions of the holders are substantially the same as the shape and the dimensions of the cross-section of a heating element, so that a suitable thermal contact is obtained.

The holders have a cylindrical or prismatic shape in accordance with the cylindrical or prismatic shape of the heating elements used.

On the other hand, after having been introduced into their holder, the heating elements may be crimped or soldered or brazed in order to improve the thermal contact with the heating plate.

The features of the invention and the embodiments in accordance with the invention will become apparent from the following description which is given with reference to the accompanying drawings.

FIG. 1 is a longitudinal partially sectional view of a heating plate taken parallel to the transport direction of the inked paper thereon, said heating plate comprising cylindrical heating elements.

FIG. 2 is a cross-sectional view of a similar heating plate, taken in the plane of the axis of one of the heating elements.

As appears from FIG. 1, the heating plate, being formed as an aluminium sheet having a thickness of 0.5 mm, comprises a rectangular portion 1 which is dimensioned 27 mm×220 mm and whose sides which extend parallel to the larger dimension are rolled towards the underside of the plate so as to form two cylindrical holders 3 and 4 which have a diameter of 4 mm and which serve to accommodate the cylindrical heating elements 5 and 6 which have a length of 230 mm and a diameter of 3.7 mm. The intermediate spaces 11 and 12 between the heating element and its holder may be filled up either by contracting the holder around the heating element (crimping), or by soldering with tin solder at a temperature of 210° C., or by brazing with silver-copper-cadmium at a temperature of 600° C. in order to ensure suitable thermal contact between the elements and the heating plate.

FIG. 2 is a cross-sectional view, with respect to the paper transport direction, of the heating element 5 (or 6, because these elements are identical) in its holder 3 (or 4). The heating coil 20 of nickel-chromium has a length of 220 mm and is mechanically protected by a stainless steel sheath 21 which has a diameter of 3.7 mm and a length of 230 mm and which is filled with magnesium powder 22 which provides electrical protection. Two nickel stems 7 and 8 are embedded at each end 27, 28 of the heating coil 20 and are soldered thereto over a length of 5 mm in order to form electrical connections.

The conductors 7 and 8 are insulated from the sheath 21 by two caps 23, 24 or polytetrafluoroethylene (PTFE). The sheath is moisture-tight thanks to use of two epoxy-resin caps 25 and 26.

The connections 7 and 8 of the heating element 5 as well as the connections of the heating element 6 are either interconnected or connected to the supply voltage so that the heating elements are connected in serie when the supply voltage is 220 volts or in parallel when the supply voltage is 110 volts. In these circumstances the operating temperature of such a heating plate (140° C.) is reached in 14 seconds.

In a heating plate in accordance with the invention, breaking due to thermal shocks is precluded in that all parts of the device which are subject to elevated temperatures are made of metal or a refractory material.

The invention relates to printing apparatus in general and notably to teleprinters; because its operating temperature is very quickly reached, such a heating plate is suitable for being activated by the same command which activates the teleprinter system.

It is to be noted that the use of the invention is not restricted to printing apparatus and that within the scope of the invention many alternatives can be found by those skilled in the art, as will appear from the attached claims.

What is claimed is:

1. A heating plate for drying inked paper in a printing apparatus, comprising two elongated heating elements, having a powdered metal therein and a metal sheet having first and second faces, the first face comprising a rectangular central portion which serves to receive the inked paper, said central portion having a largest dimension, the metal sheet having two end portions which extend parallel to this dimension, said two end portions being folded towards the second face so as to form two holders which each serve to accommodate and retain one of said longated heating elements, said holders each having a cross-section whose shape and internal dimensions are substantially the same as the shape and external dimensions of said heating elements and having intimate thermal contact therebetween.

2. A heating plate as claimed in claim 1, characterized in that the heating elements are of a type which comprises an insulating mineral at the axial extremities thereof.

3. A heating plate as claimed in claim 1 or 2 wherein said heating elements and said holders receiving said elements have a cylindrical shape.

4. A heating plate as claimed in any one of the claims 1 or 2, characterized in that the elements are secured in their holder by crimping.

5. A heating plate as claimed in claim 1 or 2 wherein said plate is formed by a sheet of aluminum which has a thickness of 0.5 mm and whose rectangular central portion is dimensioned $27 \times 220$ mm, its sides being rolled towards an underside of the plate in order to form cylindrical holders which serve to receive said heating elements the elements being of type which comprises an insulating mineral at axial extremities thereof, said elements having a diameter of 3.7 mm and a length of 230 mm.

* * * * *